US006971572B2

(12) United States Patent
Ikeda

(10) Patent No.: US 6,971,572 B2
(45) Date of Patent: Dec. 6, 2005

(54) CARTON

(75) Inventor: Tamio Ikeda, Kawasaki (JP)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 385 days.

(21) Appl. No.: 10/423,336

(22) Filed: Apr. 24, 2003

(65) Prior Publication Data

US 2005/0167476 A1 Aug. 4, 2005

Related U.S. Application Data

(63) Continuation of application No. PCT/US01/45113, filed on Oct. 24, 2001.

(30) Foreign Application Priority Data

Oct. 24, 2000 (JP) ..... 200-323-530

(51) Int. Cl.[7] ..... B65D 5/462

(52) U.S. Cl. ..... 229/117.13; 229/117.12; 229/117.22; 229/117.24

(58) Field of Search ..... 229/117.12, 117.13, 229/117.22, 117.24; 206/141, 427

(56) References Cited

U.S. PATENT DOCUMENTS

| | | | | | |
|---|---|---|---|---|---|
| 2,955,739 | A | * | 10/1960 | Collura | 229/117.13 |
| 4,166,570 | A | * | 9/1979 | Lazerand et al. | 229/117.24 |
| 4,498,619 | A | * | 2/1985 | Roccaforte | 229/117.13 |
| 4,538,759 | A | | 9/1985 | Dutcher | |
| 4,546,914 | A | | 10/1985 | Roccaforte | |
| 4,583,681 | A | * | 4/1986 | Neese | 229/117.22 |
| 5,297,725 | A | * | 3/1994 | Sutherland | 229/117.13 |
| 5,320,277 | A | * | 6/1994 | Stout et al. | 229/117.13 |
| 5,385,234 | A | * | 1/1995 | Stout et al. | 206/427 |
| 5,482,203 | A | | 1/1996 | Stout | |
| 5,639,017 | A | | 6/1997 | Fogle | |
| 5,647,483 | A | | 7/1997 | Harris | |
| 5,738,273 | A | | 4/1998 | Auclair | |
| 5,826,783 | A | | 10/1998 | Stout | |
| 5,915,546 | A | | 6/1999 | Harrelson | |
| 6,065,590 | A | | 5/2000 | Spivey | |
| 6,425,520 | B1 | * | 7/2002 | Peterson | 229/117.13 |

FOREIGN PATENT DOCUMENTS

| | | |
|---|---|---|
| EP | 0 754 631 A1 | 1/1997 |
| EP | 0 770 022 B1 | 9/1998 |
| EP | 0 813 486 B1 | 5/1999 |

* cited by examiner

*Primary Examiner*—Gary E. Elkins
(74) *Attorney, Agent, or Firm*—Tsugihiko Suzuki

(57) ABSTRACT

A carton includes a base wall, a pair of side walls hingedly connected to opposed side edges of the base wall, a first top panel hingedly connected to an upper edge of one of the side walls, a pair of end flaps hingedly connected to opposed end edges of the top panel and extending toward the base wall, a finger aperture defined in the top panel, and a strap handle disposed slidably with respect to an underside of the top panel and exposed to view within the finger aperture. The strap handle includes a main strap having a medial portion extending parallel to opposed side edges of the top panel. The opposite ends of the main strap are hingedly connected to the end flaps along fold lines. Each fold line extends parallel to a notional line extending between the top panel and the base wall.

10 Claims, 7 Drawing Sheets

CARTON

This is a continuation of international application No. PCT/US01/45113, filed Oct. 24, 2001, which is hereby incorporated by reference.

BACKGROUND OF THE INVENTION

This invention relates generally to cartons useful to package articles such as cans, and more particularly to a carton having a strap handle by which it may be carried.

A type of conventional carton includes a base panel, a pair of side wall panels hingedly connected to the opposed side edges of the base panel, a top panel hingedly connected to the upper edge of one of the side wall panels and a pair of partial end wall panels foldably connected to the opposed end edges of the top panel and extending toward the base panel. Japanese Patent Publication No. 9-502148 discloses a carton of the above type, having a handle strap connected to the partial end wall panels along vertical fold lines so that the carton may be carried by the strap handle. The handle may be formed from the material located adjacent to the top panel at an end of the carton blank. This is of benefit because a second top panel such as shown in U.S. Pat. No. 5,639,017 may be omitted from the blank, which would save the cost of the carton material. The handle strap of the above Japanese publication, however, is glued to the underside of the top panel as well as to that of the so-called "suitcase handle" formed integrally with the top panel. As a result, it is required in order to grip the strap that the carton (the top panel in particular) be forcibly deformed within its tolerance to create a hand room under the handle strap. This is a drawback from a standpoint of an end user because it is simply difficult to grip the handle strap.

What is needed, therefore, is a carton that facilitates formation of a hand room under a handle strap and allows a user to easily access the handle strap so that he can carry the carton.

SUMMARY OF THE INVENTION

According to the present invention, there is provided a carton including a base panel, a pair of side wall panels hingedly connected to the opposed side edges of the base panel, a top panel hingedly connected to the upper edge of one of the side wall panels, a pair of end flaps hingedly connected to the opposed end edges of the top panel and extending toward the base panel, a finger aperture defined in the top panel, and a strap handle disposed slidably with respect to the underside of the top panel and exposed to view within the finger aperture. The strap handle includes a main strap having a medial portion extending parallel to the opposed side edges of the top panel. The opposite ends of the main strap are hingedly connected to the end flaps along fold lines. Each of these fold lines extends parallel to a notional line extending between the top and base panels. Because the strap handle is disposed slidably with respect to the top panel and exposed to view within the finger, a part of the strap handle may bow upwardly and protrude through the finger aperture when the end flaps are folded into their closing positions and thereby the strap handle becomes slack. By this means, formation of a hand room under the strap handle can be facilitated.

According to a preferred embodiment of the invention, the strap handle may include an outside strap disposed along the upper surface of the main strap. The outside strap may be formed from the top panel, extend longitudinally across the finger aperture and connected at its opposite ends to the top panel by tear lines respectively. The outside strap prevents the uncoated side of the handle material of the main strap from being exposed to view.

According to another preferred embodiment of the invention, the strap handle may include a reinforcing strap extending along and hingedly connected to the main strap. The reinforcing strap may be adhesively secured to the main strap. The reinforcing strap may be disposed at the underside of the main strap. This arrangement allows the main strap to be directly secured to the inside surfaces of the end flaps without the reinforcing strap being interposed therebetween, which in turn allows a greater surface of the end portions of the main strap effectively secured to the end flaps. Accordingly, it is insured that the strap handle is strongly attached to the end flaps.

According to a further preferred embodiment, a second top panel may be hingedly connected to the upper edge of the other side wall panel and it is secured to the underside of the first top panel. The strap handle may include a secondary strap formed from the second top panel. The secondary strap may extend along the underside of the main strap. In such an arrangement, the strap handle is less bulky than it would be when the secondary strap were formed from material adjacent to the first top panel.

According to a still further preferred embodiment, the reinforcing strap may be secured to the upper surface of the main strap, the outside strap may be secured to the upper surface of the reinforcing strap, and the secondary strap may be secured to the underside of the main strap. This arrangement provides a handle with an excellent physical strength because each strap of the strap handle is secured to a next adjacent strap would.

BRIEF DESCRIPTION OF THE DRAWINGS

Exemplary embodiments will now be described, by way of example only, with reference to the accompanying drawings, in which.

DETAILED DESCRIPTION OF THE PREFERRED EMBODIMENTS

Figure 1:
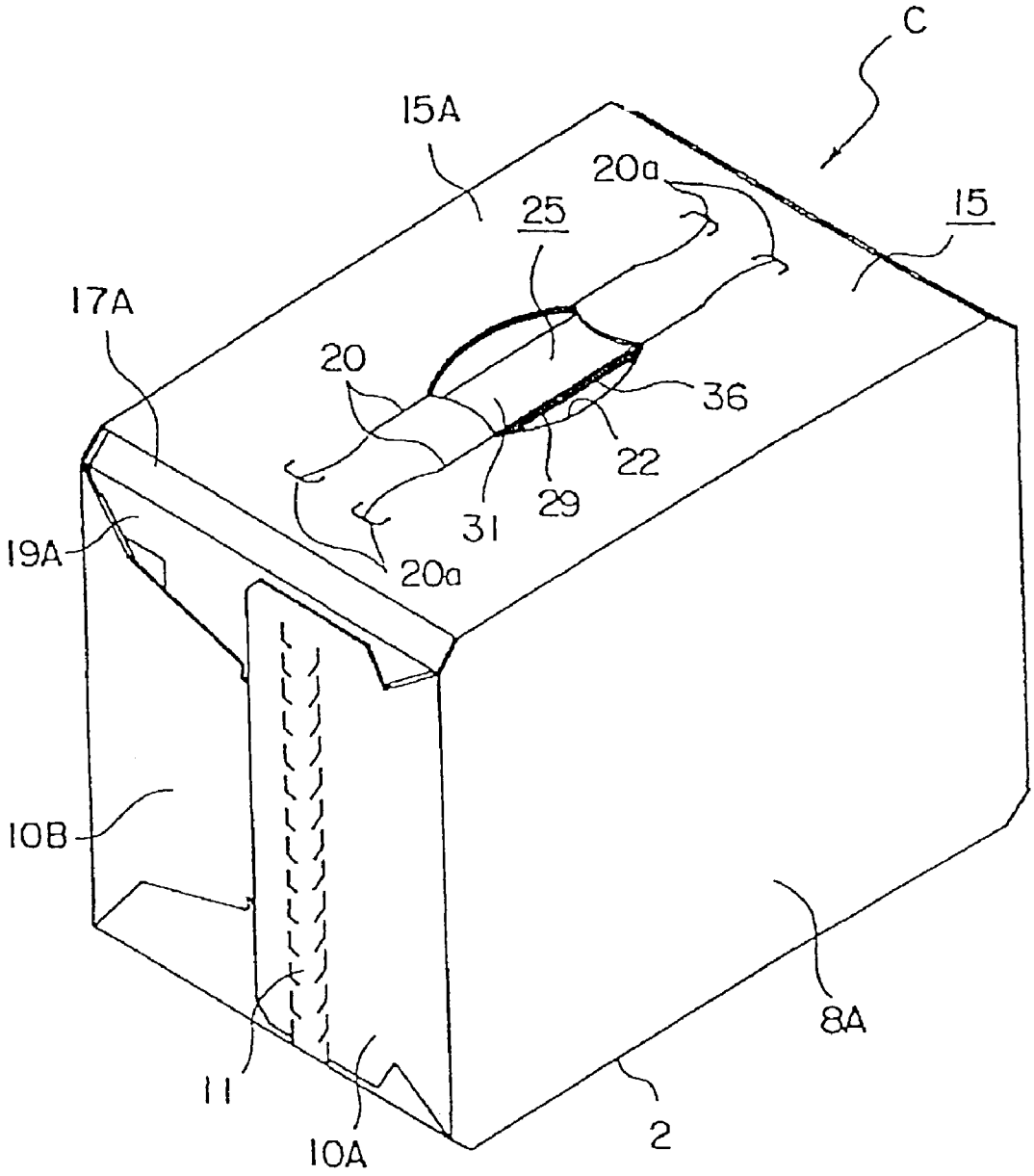
FIG. 1 is a perspective view of a carton according to a first embodiment of the invention.
Figure 2:
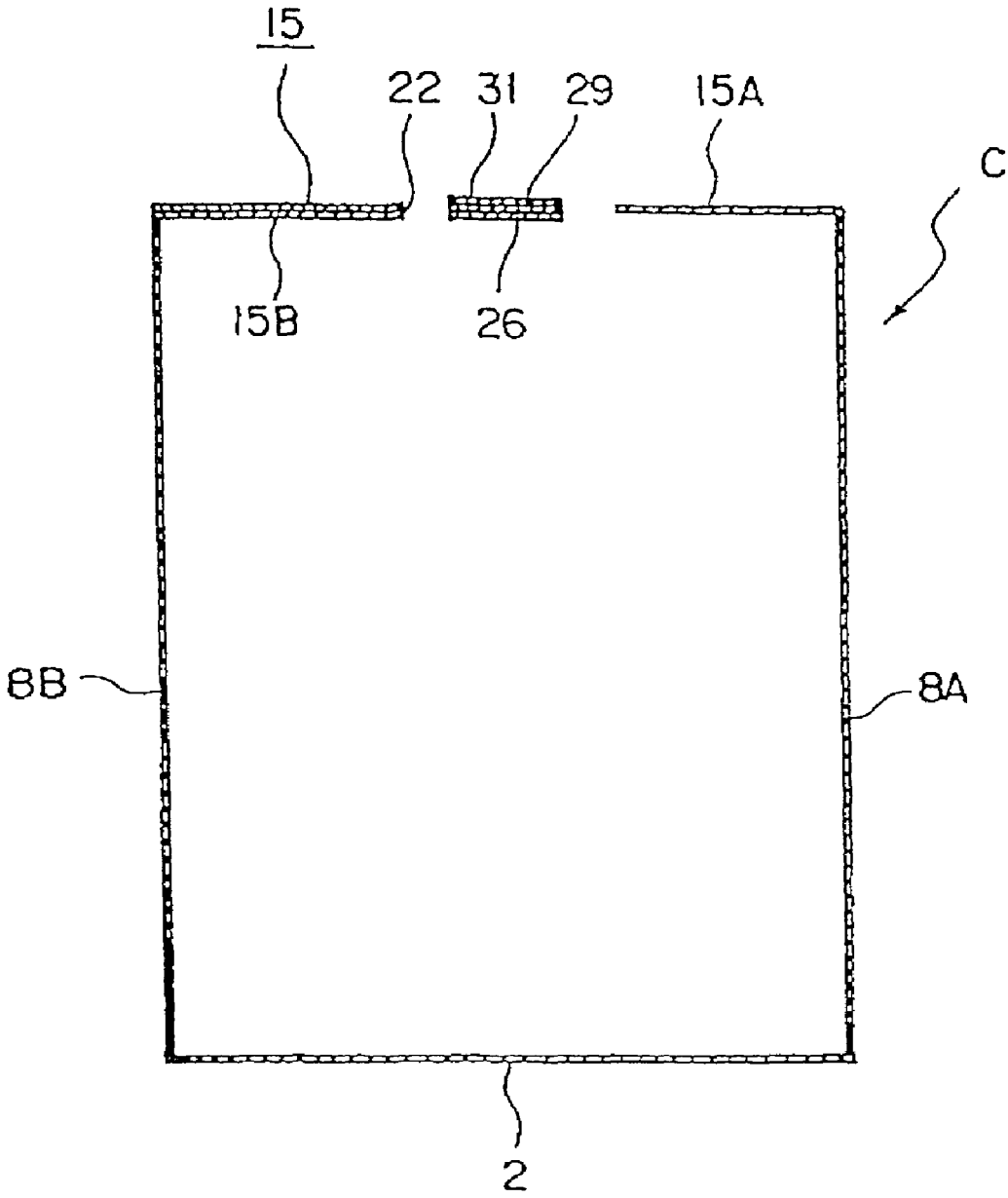
FIG. 2 is a vertical section of the carton of FIG. 1.
Figure 3:
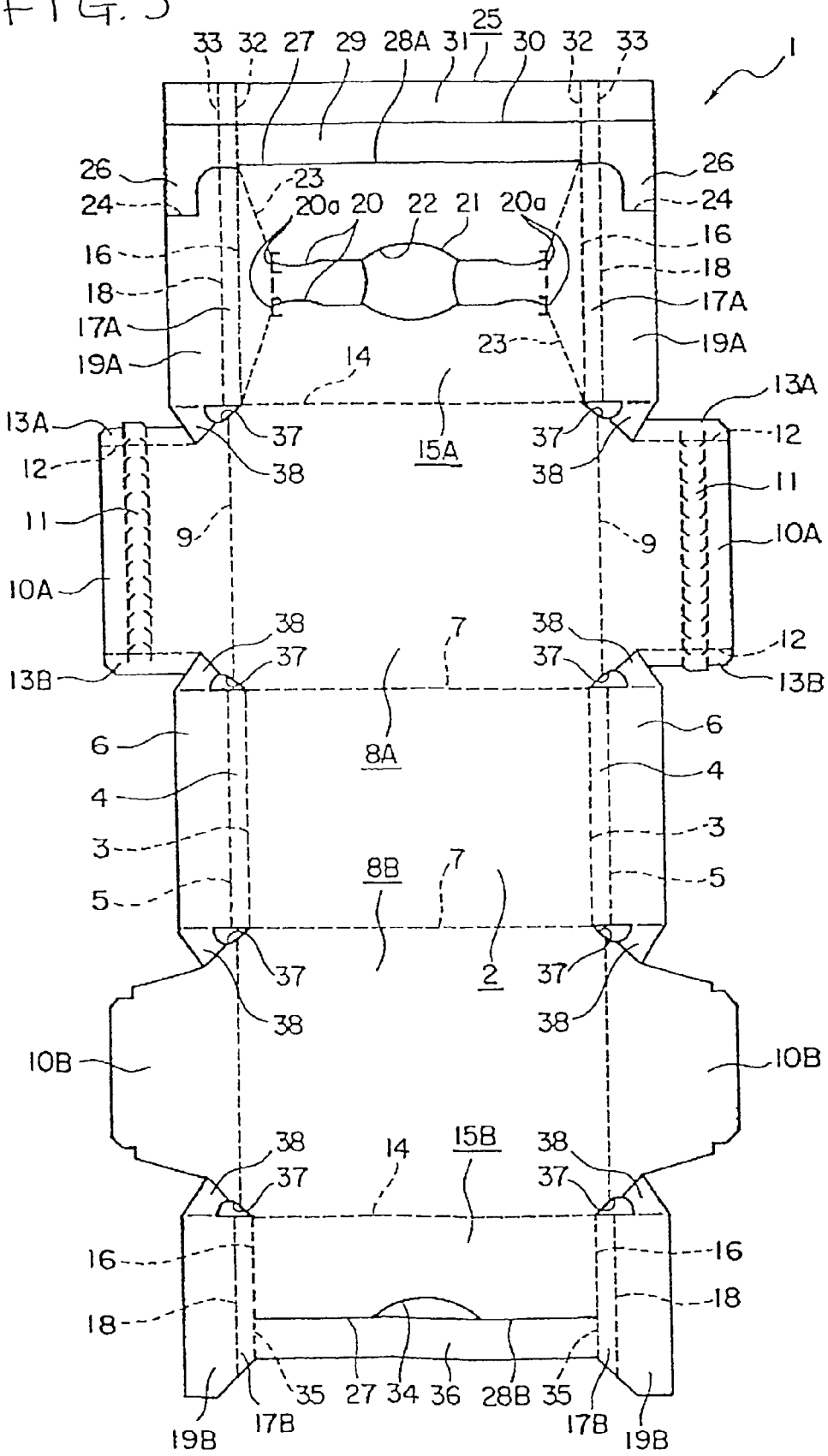
FIG. 3 is a plan view of a blank for forming the carton of FIG. 1.

FIGS. 1–3 illustrate the first embodiment of the present invention, in which FIG. 3 shows a blank from which the carton of the invention is erected. The blank is essentially rectangular in shape and is formed, in this embodiment, of paperboard. However, the blank may be formed of similar foldable material such as a plastic sheet. The blank 1 of this embodiment is designed for packaging twelve 500-ml beer cans arranged in three rows of four cans each. The blank 1 includes a rectangular base panel 2 located about midway along the length of the blank. A pair of bevelled panels 4 are connected to the opposite end edges of the base panel 2 along fold lines 3 respectively. When the blank is erected into a carton, the bevelled panels 4 are disposed at an angle with respect to the base panel 2. The inclination angle of each bevelled panel 4 is designed to correspond to the shape of each can that is to be packaged in the carton. A pair of lower end flaps 6 are connected to the bevelled panels 4 along fold lines 5 respectively. When the blank 1 is erected into a carton, the lower end flaps 6 extend toward a top panel 15 that is described later.

At the opposed side edges of the base panel 2, there are provided a pair of rectangular side wall panels 8A and 8B. These side wall panels are connected to the base panel 2 along fold lines 7 and 7 respectively. Each side wall panel is provided at its opposite end edges with side end flaps 10A and 10B. These end flaps 10A and 10B are connected to the respective side wall panel along fold lines 9. The length of each end flap 10A and 10B along a notional line perpendicular to the length of the blank is about 57% of the width of the associated side wall panel along the length of the blank. The side end flaps 10A and 10A are generally rectangular in shape. Each side end flap 10A includes a vertically extending tear strip 11 for tearing the carton wall to access the contents of the carton. Each side end flap 10A further includes a pair of sloping panels 13A and 13B connected along fold lines 12 and 12 respectively. The side end flaps 10B and 10B, on the other hand, are of generally a trapezoidal configuration.

At the side edge of the side wall panel 8A opposite to the fold line 7, there is provided a first top panel 15 while at the side edge of the side wall panel 8B opposite to the fold line 7, there is provided a second top panel 15B. These top panels 15A and 15B are connected to the side wall panels 8A and 8B along fold lines 14 and 14 respectively. The top panel 15A is rectangular in shape in a similar manner to the base panel 2. The first top panel 15A is provided at its opposite end edges with bevelled panels 17A and 17A. These bevelled panels 17A are connected to the top panel 15A along fold lines 16 and 16 respectively. A pair of upper end flaps 19A and 19A are connected to the bevelled panels 17A and 17A along fold lines 18 and 18 respectively. The upper end flaps 19A are designed to extend toward the base panel 2 when the blank 1 is erected into a carton.

At around the center of the top panel 15A, a pair of tear lines 20 and 20 are disposed side by side at a space. These tear lines 20 and 20 extend almost across the top panel 15A. However the ends of the tear lines 20 are spaced apart from the adjacent fold lines 16. The tear lines 20 and 20 are positioned and shaped to be symmetrical about a notional longitudinal center line of the top panel 15A. Each tear line 20 has an arched portion 21 midway between its opposite ends. A finger aperture 22 is defined between the arched portions 21 and 21 of the tear lines 20 and 20 so that the fingers of a user may be inserted into the aperture 22 to carry the carton. At the ends of each tear line 20, C-shaped cuts 20*a* are provided to prevent undesired tear of the top panel 15A. A fold line 23 emanates from each C-shaped cut 20*a* and extends to the adjacent corner of the top panel 15A.

These fold lines 23 serve to cause uniform deformation of the top panel 15A when the carton is carried by a strap handle that is described below.

A strap handle 25 is connected at its opposite ends to the upper end flaps 19A and 19A along mutually aligned spaced fold lines 24 and 24. The strap handle 25 is generally C-shaped, extends along the free side edge 28A of the first top panel 15A and connected thereto along a tear line 27 that has its opposite ends curved toward the top panel 15A. Each fold line 24 is disposed at the outer end of the associated upper end flap 19A. The fold lines 24 are disposed parallel to the fold line 14 between the side wall panel 8A and the top panel 15A. The locations of the fold lines 14 are designed such that when the strap handle 25 is folded 180 degrees along the fold lines 24, a part of the strap handle 25 may be viewed within the finger aperture 22. In this embodiment, in particular, the fold lines 24 are offset from the free side edge 28A toward the fold line 14. This arrangement requires less material than a conventional arrangement wherein the fold lines 24 are aligned with the free side edge of a top panel. The length of each fold line 24 is about 70% of the width of the associated partial end panel 19A.

The strap handle 25 comprises a main strap 29 formed integrally with the aforesaid ends 26 and 26, and a reinforcing strap 31 disposed parallel to the main strap 29 and connected thereto by a tear line 30. The main strap 29 and the reinforcing strap 31 are of generally the same width. When the reinforcing strap 31 is folded 180 degrees along the partial tear line 30, the straps 29 and 31 are brought into a face-contacting relationship. After that, the strap handle 25 is folded along the fold lines 24 and 24 so that the central portion of the strap handle 25 is exposed to view within the finger aperture 22. In addition, the strap handle 25 has fold lines 32 and 33 that are aligned with the fold lines 16 and 18 respectively.

The second top panel 15B is adapted to be glued to the underside of the first top panel 15A. The width of the second top panel 15B is about 40% of that of the first top panel 15A so that the free side edge 28B of the second top panel 15B is positioned in registry with one of the tear lines 20 of the first top panel 15A when a carton is set up. A notch 34 is formed at a central location along the free side edge 28B. This notch 34 is adapted to be positioned in registry with a part of the finger aperture 22 upon erection of a carton so that it does not block the finger aperture 22. The first and second top panels 15A and 15B are of the same length.

A pair of bevelled panels 17B and 17B are connected to the opposite end edges of the second top panel 15B along fold lines 16 and 16, and a pair of second top flaps 19B and 19B are connected to the bevelled panels 17B and 17B along fold lines 18 and 18. The bevelled panels 17B and 17B are designed to be inclined to the second top panel 15A so that the angle of inclination of each bevelled panel 17B corresponds to the shape of each can to be packaged in the carton. The second upper end flaps 19B and 19B are adapted to extend toward the base panel 2 in an erected carton.

A secondary strap 36 is provided along the free side edge 28B of the second top panel 15 and it is extended between the bevelled panels 17B and 17B. The secondary strap 36 is connected at its opposite ends to the bevelled panels 17B and 17B along fold lines 35 and 35. The secondary strap 36 has a width generally equal to that of each of the straps 29 and 31. When the strap handle 25 is brought into the folded position and the second top panel 15B is glued to the underside of the first top panel 15A, the secondary strap 36 is brought into a face-contacting relationship with the strap handle 25 to create a three-ply handle. However, the secondary strap 36 may be omitted if desired.

A web 38 is provided to connect between each side end flap and the adjacent upper or lower end flap and it is formed with an opening 37 to avoid crowing of material at the respective carton corner when a carton is erected.

Turning to the construction of the carton C illustrated in FIG. 1, the blank 1 requires a series of sequential folding and securing operations which can be performed in a straight line machine so that the carton is not required to be rotated or inverted to complete its construction. The folding process is not limited to that described below and can be altered according to particular manufacturing requirements.

The first step is to apply glue to the inside surface of the main strap 29 or the reinforcing strap 31. The reinforcing strap 31 is then folded along the partial tear line 30 onto the inside surface of the main strap 29. Glue is then applied to the opposite end portions of the reinforcing strap 31, and the straps 29 and 31 or strap handle 25 is folded 180 degrees about the fold lines 24 and 24. This secures the opposite end portions of the strap handle 25 to the inside surfaces of the upper end flaps 19A and 19A and brings the central portion of the strap handle 25 to the position where it is exposed to view within the finger aperture 22.

The next step is to apply glue to the respective outer surfaces of the second top panel 15B, the second upper end flaps 19B and 19B and the secondary strap 36 and to manipulate the blank 1 to bring the first top panel 15A onto the outer surface of the second top panel 15B. This turns the blank 1 into a flat tubular structure. The flat tubular blank is then expanded by folding the panels 2, 8A, 8B, 15A and 15B along the fold lines 7, 7, 14 and 14 so that the side wall panels 8A and 8B are separated to take spaced opposed positions. This results in the formation of an erected tubular structure formed from the top and base panels and the side wall panels 18A and 18B as well as in the formation of a three-ply strap handle, which is best shown in FIG. 2. Articles such as cans are then loaded into the tubular carton through one or both of its opposite open ends. After that, the upper and lower end flaps 19A, 19B and 6 at the opposite ends of the tubular structure are folded into vertical positions, followed by the side end flaps 10B folded inwardly into their respective closed positions. Glue is applied to the upper and lower end flaps 19A, 19B and 6 and the side end flaps 10B and then side end flaps 10A are folded to their closed positions, which results in the complete carton C shown in FIG. 1.

Referring to FIG. 1, the composite top wall 15 is formed of the first and second top panels 15A and 15B and is provided with a finger aperture 22. Among the straps 29, 31 and 36 that constitute the strap handle 25, the topmost strap or reinforcing strap 31 is not glued to but simply in contact with the inside surface or underside of the top wall 15. Therefore, when the upper end flaps 19A and 19B are folded into their closed positions, the tautness of the strap handle 25 across the composite top wall 15 is reduced so that in effect, the strap handle 25 which is free of restraint of the top wall 15 or top panels 15A and 15B becomes slack and the central portion of the strap handle 25 bows upwardly and protrudes through the finger aperture 22. Thus, the central portion of the strap handle 25 is bowed upwardly proud of the top wall 15 into a position for ready use where a hand room under the strap handle 25 is readily available for a user.

Figure 4:
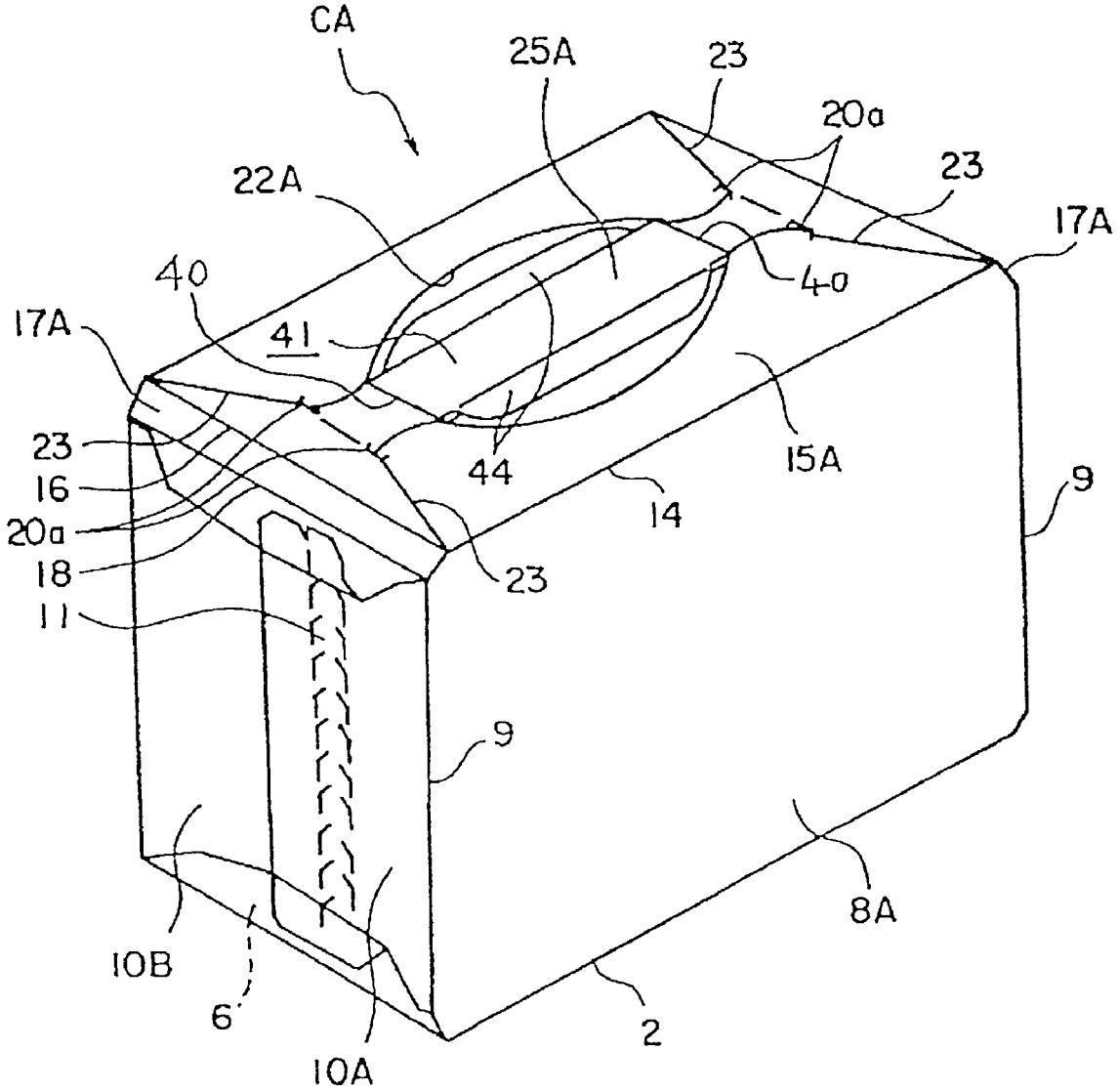
FIG. 4 is a perspective view of a carton according to a second embodiment of the invention.
Figure 5:
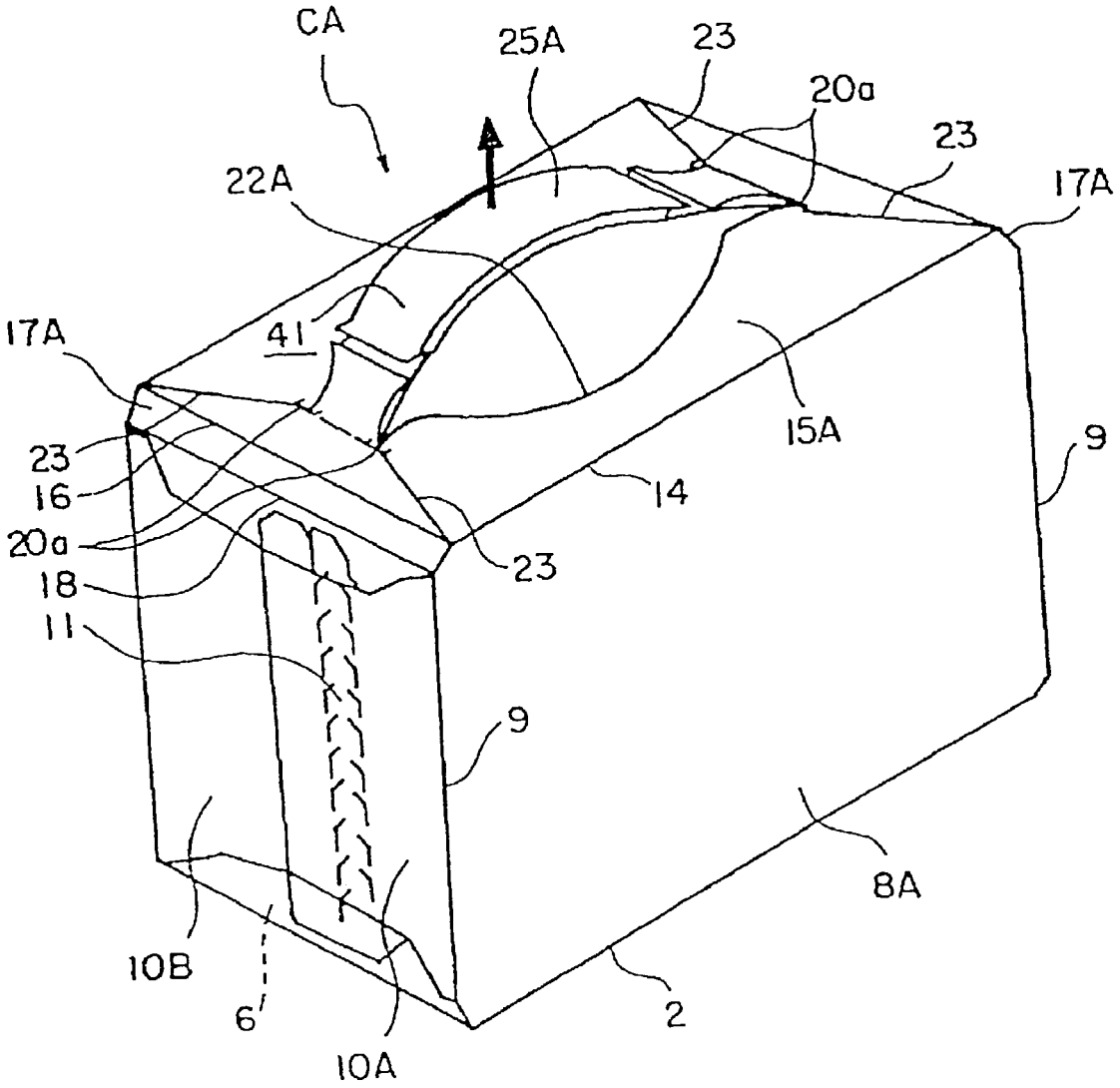
FIG. 5 is a perspective view of the carton in FIG. 4, showing a condition in which the strap handle is pulled upward.
Figure 6:
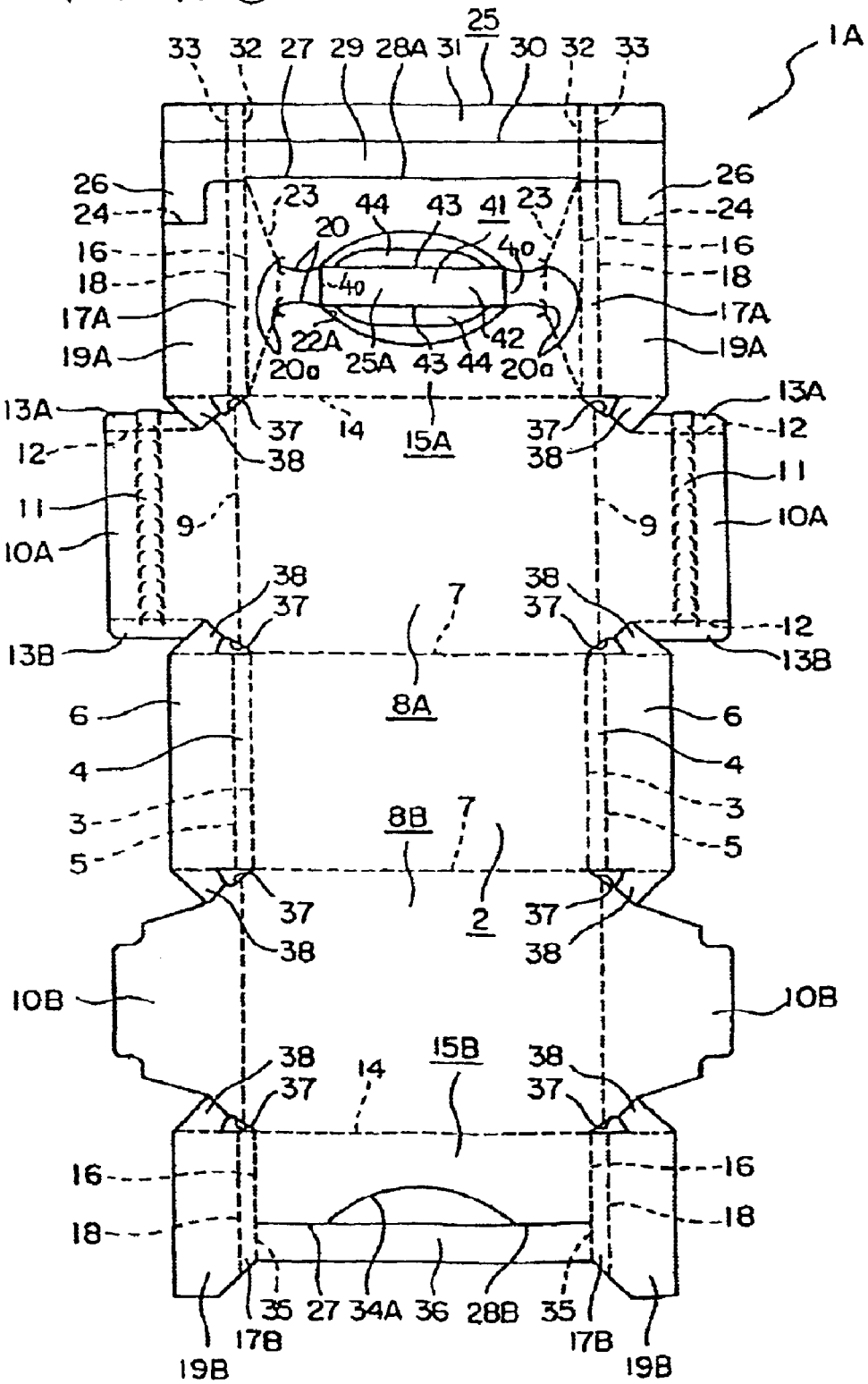
FIG. 6 is a plan view of a blank for forming the carton of FIG. 4.

FIGS. 4–6 illustrate the second embodiment of the present invention. Like reference numerals have been used for like parts of the first embodiment and therefore only the differences from the first embodiment are described in any greater detail. FIG. 6 shows a blank 1A from which the carton of the second embodiment is assembled. In the same way as the first embodiment, the blank 1A has a strap handle 25A of a three-ply structure including a main strap 29, reinforcing strap 31 and secondary strap 36. The first top panel 15A of the blank 1A is provided at its central area with a pair of laterally spaced tear lines 20 and 20 that extends to the vicinities of each bevelled panel 17A. Each tear line 20 has an intermediate arched portion 21A. The arched portions 21A and 21A of the tear lines 20 and 20 are concavely curved toward each other to define therebetween a finger aperture 22A. The distance between the arched portion is greater than that between the arched portions in the previous embodiment. The free side edge 28B of the second top panel 15B has a notch 34A formed therealong. The size of the notch 34A is also larger than that of the notch 34 in the previous embodiment.

The strap handle 25A further includes an outside strap 41 formed from the first top panel 15A. The outside strap 41 extends longitudinally across the finger aperture 22A and is connected at its opposite ends to the top panel 15A along tear lines 40 and 40. The outside strap 41 is disposed on the upper or outside surface of the reinforcing strap 31 that is glued to the upper or outside surface of the main strap 29. The outside strap 41 include a rectangular strap body 42 positioned directly on the reinforcing strap 31 and a pair of cushion flaps 44 and 44 connected to the strap body 42 along fold lines 43 and 43. These cushion flaps 44 and 44, when the strap handle is gripped, are folded downwardly along the fold lines 43 and 43 to be disposed over the side edges of the straps 29, 31 and 36 and thereby prevent user's fingers from being directly pressed against the side edges. The other parts of the carton are virtually identical to those of the first embodiment, and therefore description thereof is omitted. It is appreciated, however, that the reinforcing strap 31 may be omitted from the carton, or it may be positioned along the underside of the main strap 29 because the outside strap 41 can hide the uncoated side of the main strap 29 from view.

The process for setting up a carton from the blank 1A is also virtually identical to that of the first embodiment. However, how to handle the outside strap 41 together with its function is described hereinafter.

During the assembly of a carton CA (see FIG. 4), the reinforcing strap 31 is glued, at least in part, to the underside of the outside strap 41. However, the reinforcing strap 31 that is in contact with the underside of the first top panel 15A is free of restraint of the top wall 15. In other words, only connections between the strap handle 25A and the top wall 15 are provided by the tear lines 40 and 40. Therefore, when the strap handle 25A is pulled upwardly in the direction of the arrow in FIG. 5, the outside strap 41 is severed from the top wall 15 along the tear lines 40 and 40. By this means, the strap handle 25A becomes completely free of restraint of the top wall 15. This allows a user to easily pull out the central portion of the strap handle 25A through the finger aperture 22 while using the slack of the strap handle 25A that has already been available. The pulled-out portion of the strap handle 25A can create a bow as shown in FIG. 5 wherein a hand room under the strap handle 25A is readily available for a user.

Figure 7:
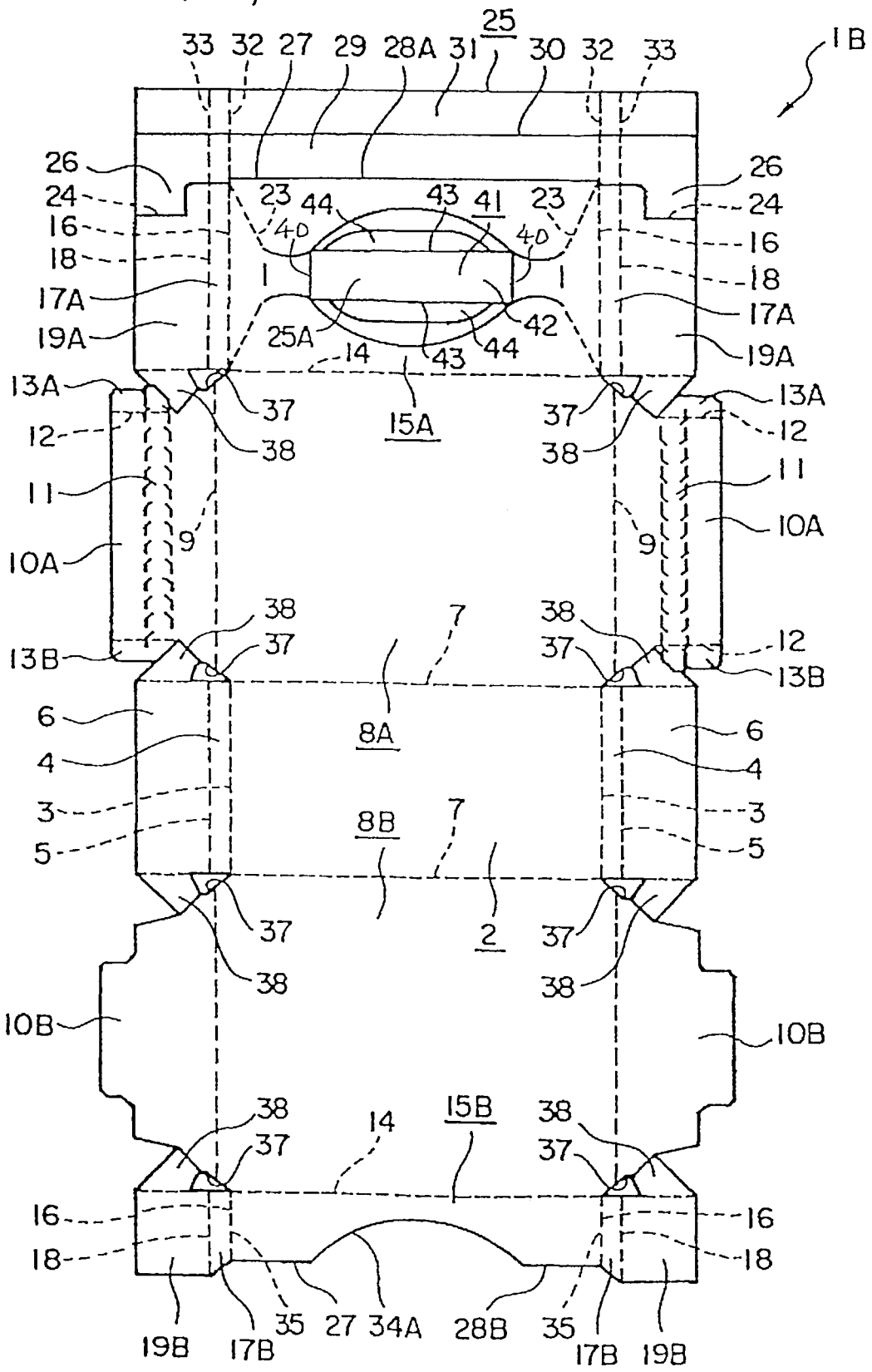
FIG. 7 is a plan view of a blank for forming a carton according to a third embodiment of the invention

FIG. 7 illustrates the third embodiment of the invention that is applied to a carton blank. In this embodiment, the number of the straps that constitute the strap handle is two instead of three that is the case in the second embodiment. The other structure of the carton of the third embodiment is virtually identical to that of the second embodiment. Like reference numerals have been used for like parts of the second embodiment and therefore only the differences from the second embodiment are described in any greater detail.

In FIG. 7, the carton blank 1B has a strap handle 25B that includes a main strap 29 and a reinforcing strap 31. The strap handle 25B is not provided with a secondary strap 36 which was in the first and second embodiments. Therefore, the lower end edge 28B of the blank 1B is completely free of any carton members. The blank 1B further differs from the blanks of the preceding embodiments in that it is not formed with C-shaped cut 20*a* that is provided at each end of the tear lines 20 and 20 in the preceding embodiments. The other structure of the carton is virtually identical to that of the second embodiment.

It should be readily apparent that the reinforcing strap 31 may be omitted from the carton or it may be glued to the underside of the main strap 29. It should be also apparent that the second top panel 15B may be replaced by a small-sized panel that merely serves as a glue flap, which would reduce the material cost of the carton.

The process for setting up a carton from the blank 1B of FIG. 7 is also virtually identical to that of the second embodiment except that the process for erecting the blank 1B does not include the steps for manipulating a secondary strap 36. The carton of the third embodiment may be used to package lightweight articles such as those having a less weight than the articles packaged in the carton of the second embodiment.

It will be recognised that as used herein, directional references such as "top", "base", "end", "side", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative top and base closure structures may be used.

What is claimed is:

1. A carton comprising a base wall, a pair of side walls hingedly connected to opposed side edges of said base wall, a first top panel hingedly connected at one of opposed side edges thereof to an upper edge of one of said side walls, a pair of end flaps hingedly connected to opposed end edges of said top panel and extending toward said base wall, a finger aperture defined in said top panel, and a strap handle disposed slidably with respect to an underside of said top panel and exposed to view within said finger aperture, wherein said strap handle includes a main strap having a medial portion extending parallel to said opposed side edges of said top panel, opposite ends of said main strap are hingedly connected to said end flaps along fold lines, and each of said fold lines extends parallel to a notional line extending between said top panel and said base wall, said fold lines being offset from the other side edge of said top panel toward said one side edge of said top panel.

2. The carton according to claim 1 wherein said strap handle further includes an outside strap disposed along an upper surface of said main strap, and said outside strap is formed from said top panel, extends across said finger aperture and is connected at opposite ends thereof to said top panel by tear lines respectively.

3. The carton according to claim 1 wherein said strap handle includes a reinforcing strap extending along and hingedly connected to said main strap, said reinforcing strap being secured to said main strap.

4. The carton according to claim 3 wherein said reinforcing strap is disposed along an underside of said main strap.

5. The carton according to claim 1 further comprising a second top panel hingedly connected to an upper edge of the other side wall, said second top panel being secured to an underside of said first top panel, and said strap handle further includes a secondary strap formed from said second top panel and extending along an underside of said main strap.

6. The carton according to claim 1 further comprising a second top panel hingedly connected to an upper edge of the other side wall, and a pair of second end flaps hingedly connected to opposed end edges of said second top panel and extending toward said base wall, said second top panel being secured to an underside of said top panel, said second end flaps being disposed in part along inside surfaces of said first end flaps respectively such that each of opposite end portions of said strap handle is secured between a respective one of said first end flaps and a respective one of said second end flaps.

7. The carton according to claim 6 wherein said strap handle further includes a secondary strap formed from said second top panel and extending along an underside of said main strap.

8. The carton according to claim 2 further comprising a second top panel hingedly connected to an upper edge of the other side wall, and a pair of second end flaps hingedly connected to opposed end edges of said second top panel and extending toward said base wall, said second top panel being secured to an underside of said top panel, said second end flaps being disposed in part along inside surfaces of said first end flaps respectively such that each of opposite end portions of said strap handle is secured between a respective one of said first end flaps and a respective one of said second end flaps.

9. The carton according to claim 8 wherein said strap handle further includes a secondary strap formed from said second top panel and extending along an underside of said main strap.

10. The carton according to claim 9 wherein said reinforcing strap is secured to an upper surface of said main strap, said outside strap is secured to an upper surface of said reinforcing strap, and said secondary strap is secured to an underside of said main strap.

* * * * *